US005711365A

United States Patent [19]

Shimizu et al.

[11] Patent Number: 5,711,365

[45] Date of Patent: Jan. 27, 1998

[54] SHELL MOLDING APPARATUS

[75] Inventors: Akio Shimizu, Yokkaichi; Taiti Yoshikawa, Kameyama; Hiroshi Suzuki, Suzuka; Shigeyuki Kinoshita; Keiji Wada, both of Kameyama; Yasuo Kawai, Suzuka, all of Japan

[73] Assignee: Honda Giken Kogyo Kabushiki Kaisha, Tokyo, Japan

[21] Appl. No.: 626,605

[22] Filed: Apr. 2, 1996

[30] Foreign Application Priority Data

| | | | |
|---|---|---|---|
| Apr. 3, 1995 | [JP] | Japan | 7-077877 |
| Apr. 4, 1995 | [JP] | Japan | 7-078957 |
| Apr. 4, 1995 | [JP] | Japan | 7-078958 |

[51] Int. Cl.[6] ..... B22C 13/08; B22C 17/00; B22C 15/02

[52] U.S. Cl. ..... 164/165; 164/227; 164/213; 164/180; 164/181; 164/187; 164/194; 164/210; 29/888.06; 29/888.061

[58] Field of Search ..... 164/165, 227, 164/213, 18, 24, 27, 29, 40, 180, 181, 187, 194, 210; 29/888.061, 888.06

[56] References Cited

U.S. PATENT DOCUMENTS

| | | | |
|---|---|---|---|
| 4,203,484 | 5/1980 | Bührer | 164/227 |
| 5,291,862 | 3/1994 | Katoh et al. | 29/888.061 |

FOREIGN PATENT DOCUMENTS

| | | |
|---|---|---|
| 4123892 | 5/1915 | Japan . |
| 4123893 | 5/1915 | Japan . |
| 5177334 | 7/1993 | Japan . |
| 5177335 | 7/1993 | Japan . |
| 5180066 | 7/1993 | Japan . |
| 560639 | 8/1993 | Japan . |
| 5272400 | 10/1993 | Japan . |
| 623514 | 2/1994 | Japan . |
| 623515 | 2/1994 | Japan . |
| 6190504 | 7/1994 | Japan . |
| 663248 | 9/1994 | Japan . |
| 791312 | 4/1995 | Japan . |
| 7251254 | 10/1995 | Japan . |

*Primary Examiner*—Joseph J. Hail, III
*Assistant Examiner*—Ing-Hour Lin
*Attorney, Agent, or Firm*—Sughrue, Mion, Zinn, Macpeak & Seas, PLLC

[57] ABSTRACT

A shell molding apparatus includes a lower die and an upper die. The lower die includes a plurality of shell molding inserts, each having the shape of a halved cylinder, spiny insert receiving recesses which are formed in undercut portions formed by curved surfaces of adjacent shell molding inserts, and spiny inserts retractably provided in the spiny insert receiving recesses, each spiny insert having a curved surface of the same curvature as the curved surface of the shell molding insert and provided with many protrusions on the curved surface. The upper die has a plurality of continuously formed recesses corresponding to the plurality of shell molding inserts of the lower die. The shell molding apparatus further includes a spiny insert actuating mechanism for projecting/retracting spiny inserts by operating withdrawal pins connected to the spiny inserts, a stopper mechanism for positioning the withdrawal pins at a position where the withdrawal pins exhibit the same thermal expansion, and a thermal expansion absorbing mechanism for the withdrawal pins. The shell molding apparatus further includes a sand releasing mechanism for preventing shell sand from stagnating between spiny insert receiving recesses and the spiny inserts, resulting in smooth performance of the spiny inserts.

14 Claims, 22 Drawing Sheets

SHELL MOLDING APPARATUS

BACKGROUND OF THE INVENTION

1. Field of the Invention

The present invention relates to a shell molding apparatus for molding a shell mold for casting a cylindrical product, such as a sleeve for use in a cylinder block.

2. Description of the Related Art

In a general practice for manufacturing a cylinder block 80 as shown in FIG. 29, a plurality of cylindrical sleeves 81 are manufactured by casting, and the sleeves 81 are then disposed into the cavity of a die casting die. Subsequently, a molten aluminum alloy is charged into the cavity to cast the cylinder block 80.

For reliable engagement between the sleeves 81 and a block body 82 of aluminum alloy, the sleeves 81 have many protrusions on the surface thereof. According to a conventional practice, such cylindrical sleeves are cast one by one during a casting process using a sand mold formed of greensand or sand which hardens with time. Due to the required use of desertion cores, this conventional method of manufacturing sleeves requires much labor, is inefficient, and further has a drawback that it cannot be used to mass-produce double sleeves or sleeves of a higher multiple.

SUMMARY OF THE INVENTION

The present invention has been achieved in view of the problems described above and of additional problem involving degradation in precision of a molded shell mold due to the occurrence of thermal expansion or of shell sand stagnating while molding a shell mold. A first object of the present invention is to provide a she I molding apparatus capable of reducing variations in precision of shape matching between a spiny insert and a shell molding insert in spite of the occurrence of thermal expansion.

A second object of the present invention is to provide a shell molding apparatus capable of moving spiny inserts in an equalized manner in spite of the occurrence of thermal expansion.

A third object of the present invention is to provide a shell molding apparatus which prevents shell sand from stagnating between a spiny insert receiving recess and a spiny insert so as to smoothly utilize the spiny inserts, whereby halved shell molds of high precision are readily mass-produced.

In order to attain the first object described above, a shell molding apparatus according to the present invention includes a lower die composed of a plurality of shell molding inserts, each having the shape of a halved cylinder; spiny insert receiving recesses which are formed in undercut portions formed by curved surfaces of adjacent shell molding inserts; and spiny inserts retractably provided in the spiny insert receiving recesses, each spiny insert having a curved surface of the same curvature as the curved surface of the shell molding insert and provided with many protrusions on the curved surface. The shell molding apparatus further includes an upper die in which a body thereof has a plurality of continuously formed recesses corresponding to the plurality of shell molding inserts of the lower die; spiny insert actuating means for projecting and retracting the spiny inserts by moving withdrawal pins connected to the spiny inserts; stopper means for positioning the withdrawal pins at a position where the withdrawal pins exhibit the identical displacement due to thermal expansion; and thermal expansion absorbing means for absorbing thermal expansion of the withdrawal pins.

Preferably, the stopper means is composed of a stepped stop end formed in a rod insertion bore portion provided in the shell molding insert and an end surface of each withdrawal pin which abuts against the stepped stop end. The rod insertion bore portion has a smaller-diameter portion which extends from the stepped stop end to the spiny insert receiving recess, and the length L1 of the smaller-diameter port on is identical for all the shell molding inserts.

Preferably, the spiny insert actuating means is composed of a slide block for moving the withdrawal pins and an actuator cylinder for moving the slide block.

Preferably, the thermal expansion absorbing means is composed of a pin receiving member provided on the slide block; adjusting bolts screwed into the pin receiving member; and a spacing t formed between an end surface of each of the adjusting bolts and an end surface of each of the withdrawal pins held slidably by the slide block for absorbing variations in length of the withdrawal pins caused by thermal expansion.

In order to attain the second object described above, a shell molding apparatus according to the present invention includes a lower die composed of a plurality of shell molding inserts, each having the shape of a halved cylinder; spiny insert receiving recesses which are formed in undercut portions formed by curved surfaces of adjacent shell molding inserts; and spiny inserts retractably provided in the spiny insert receiving recesses, each spiny insert having a curved surface of the same curvature as the curved surface of the shell molding insert and provided with many protrusions on the curved surface. The shell molding apparatus further includes an upper die in which a body thereof has a plurality of continuously formed recesses corresponding to the plurality of shell molding inserts of the lower die; spiny insert actuating means composed of a slide block positioned and held by a slide block positioning/holding member and holding withdrawal pins inserted into pin insertion bores and an actuating mechanism for moving the slide block; and thermal expansion differential absorbing means.

Preferably, the thermal expansion differential absorbing means is composed of lower die thermal expansion absorbing means for absorbing the thermal expansion of the lower die; and slide block thermal expansion absorbing means for absorbing the thermal expansion of the slide block.

Preferably, the lower die thermal expansion absorbing means is a pin holding portion of the slide block which is provided on the slide block positioning/holding member, into which a slide pin is slidably inserted, and which has an oblong guide bore for enabling a relative movement of the slide pin. Further, the pin holding portion of the slide block is a guide bushing.

Preferably, the slide block thermal expansion absorbing means is a pin insertion bore in the slide block which is formed oblongly in cross-section thereof for enabling the withdrawal pin to move relatively within the pin insertion bore.

In order to attain the third object described above, a shell molding apparatus according to the present invention includes a lower die composed of a plurality of shell molding inserts, each having the shape of a halved cylinder; spiny insert receiving recesses which are formed in undercut portions formed by curved surfaces of adjacent shell molding inserts; and spiny inserts retractably provided in the spiny insert receiving recesses, each spiny insert having a curved surface of the same curvature as the curved surface of the shell molding insert and provided with many protrusions on the curved surface. The shell molding apparatus further includes an upper die in which a body thereof has a plurality of continuously formed recesses corresponding to the plurality of shell molding inserts of the lower die; spiny insert actuating means for projecting and retracting the spiny insert; and sand releasing means for removing sand which gets caught between the spiny insert receiving recesses and the spiny inserts.

Preferably, the sand releasing means is composed of a sand release bore extending between a bottom portion of the spiny insert receiving recess and a sand outlet, and an air feed bore connected to the sand release bore for feeding air into the sand release bore.

Preferably, the sand releasing means is composed of a sand release bore extending between a bottom portion of the spiny insert receiving recess and a sand outlet; an air feed bore connected to the sand release bore for feeding air into the sand release bore; and a groove portion provided between the spiny insert receiving recess and the spiny insert inserted into the spiny insert receiving recess and extending from a top surface side of the shell molding insert to the bottom portion of the spiny insert receiving recess.

DETAILED DESCRIPTION OF THE INVENTION

An embodiment of the present invention will now be described with reference to the drawings.

Figure 1:
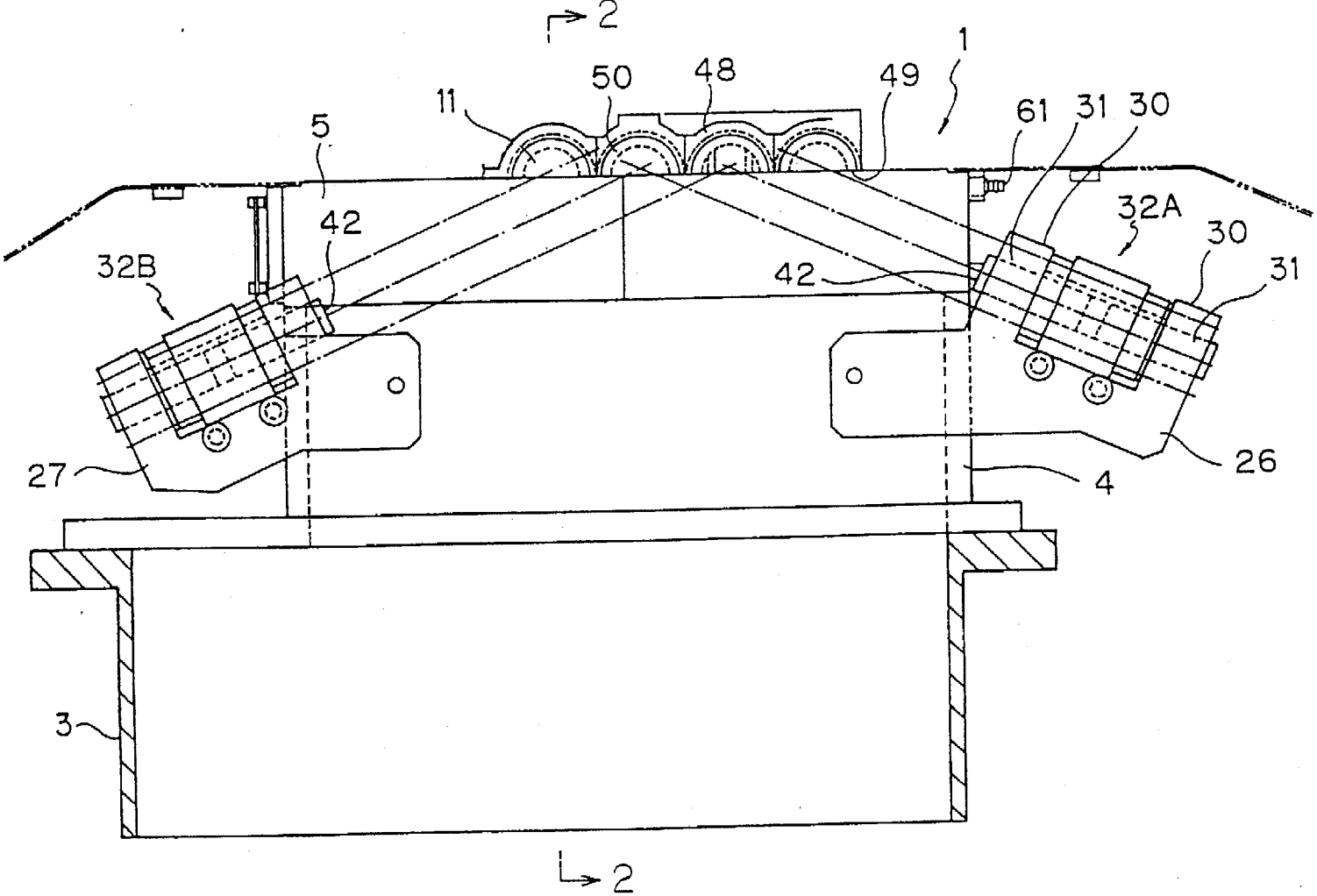
FIG. 1 is a partially cross-sectioned side view showing primarily the lower die of a shell molding apparatus according to an embodiment of the present invention.
Figure 2:
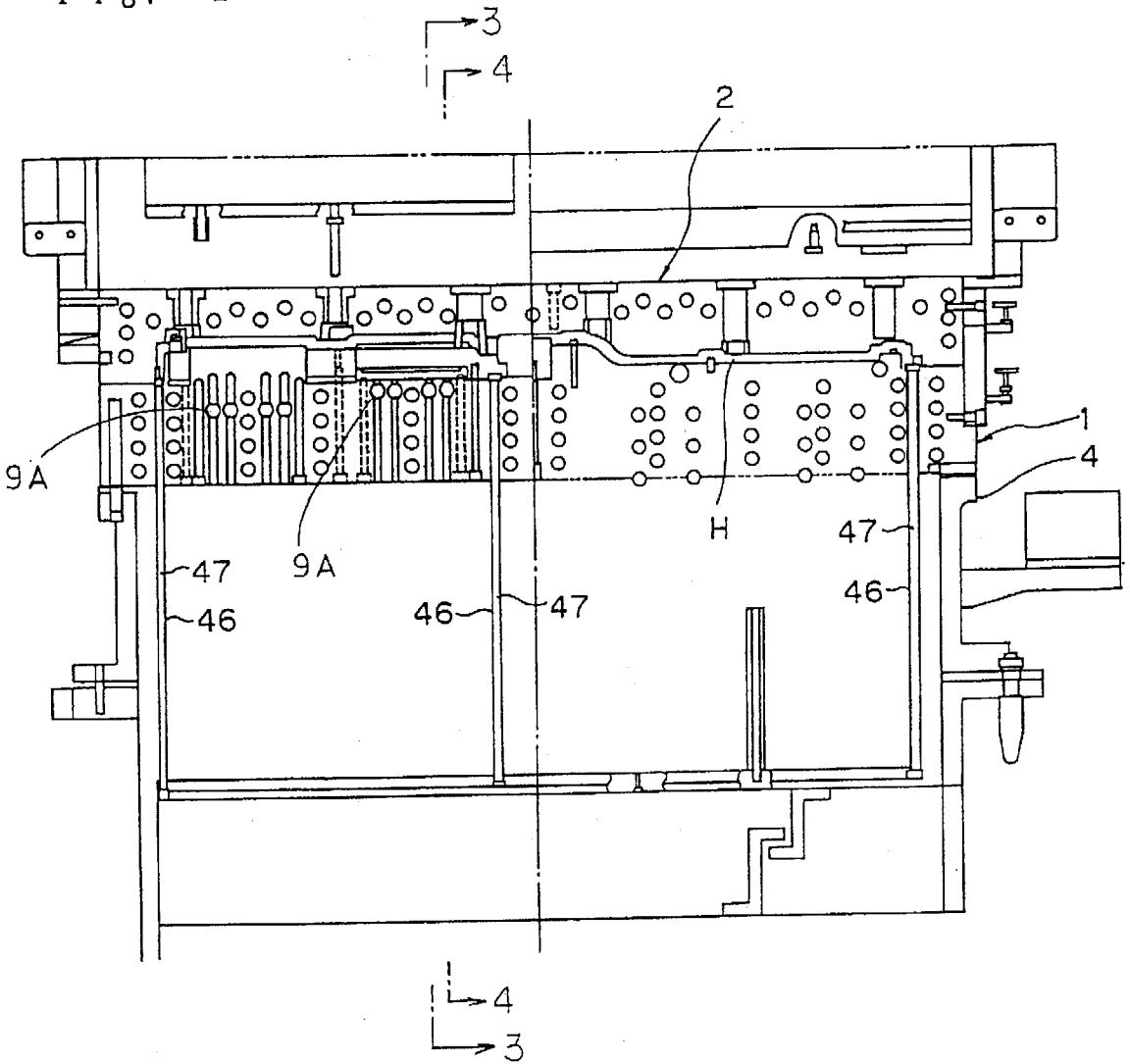
FIG. 2 is a cross-sectional view along line 2—2 of FIG. 1.
Figure 3:
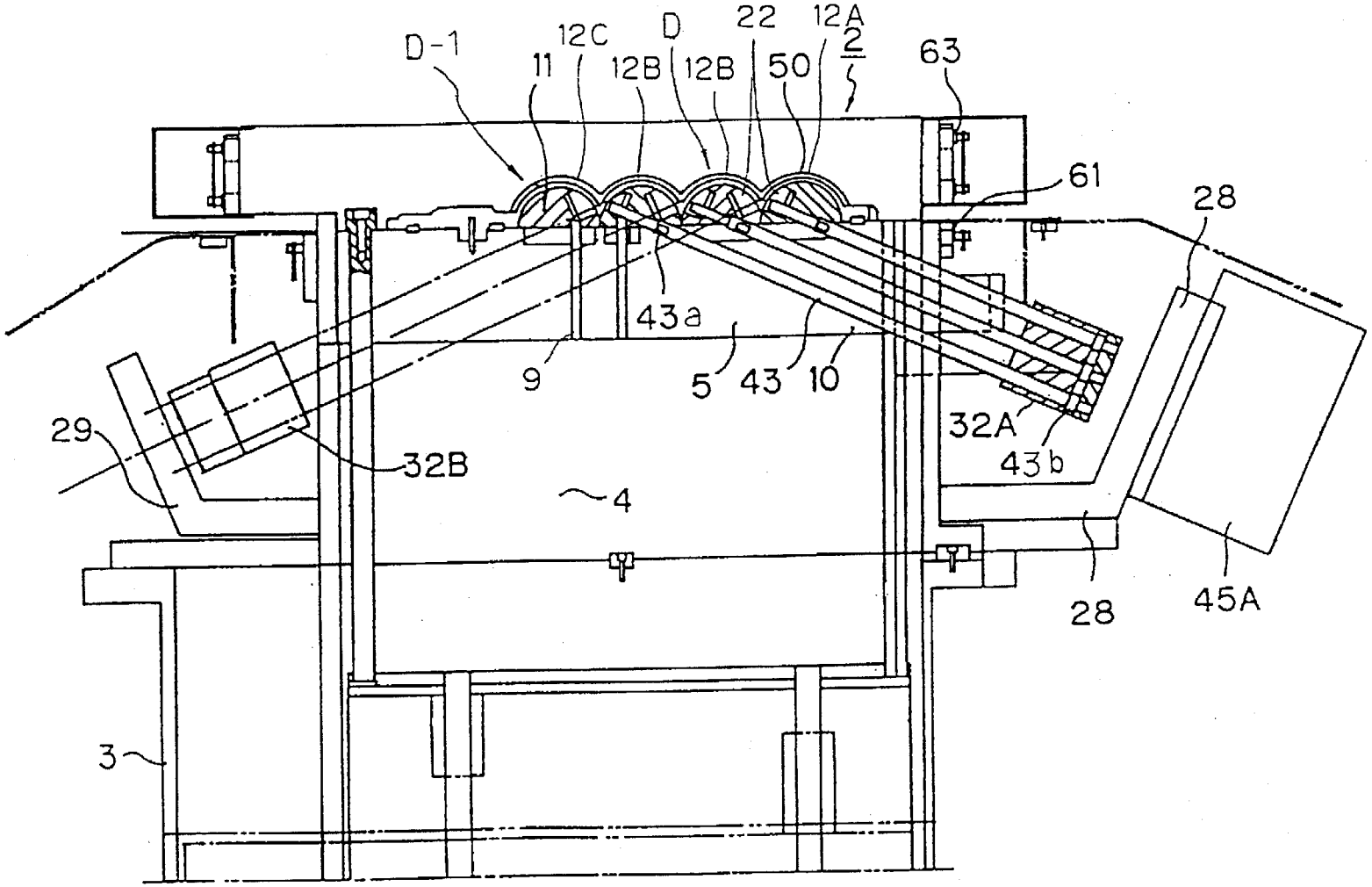
FIG. 3 is a partial cross-sectional view of the shell molding apparatus along line 3—3 of FIG. 2.
Figure 4:
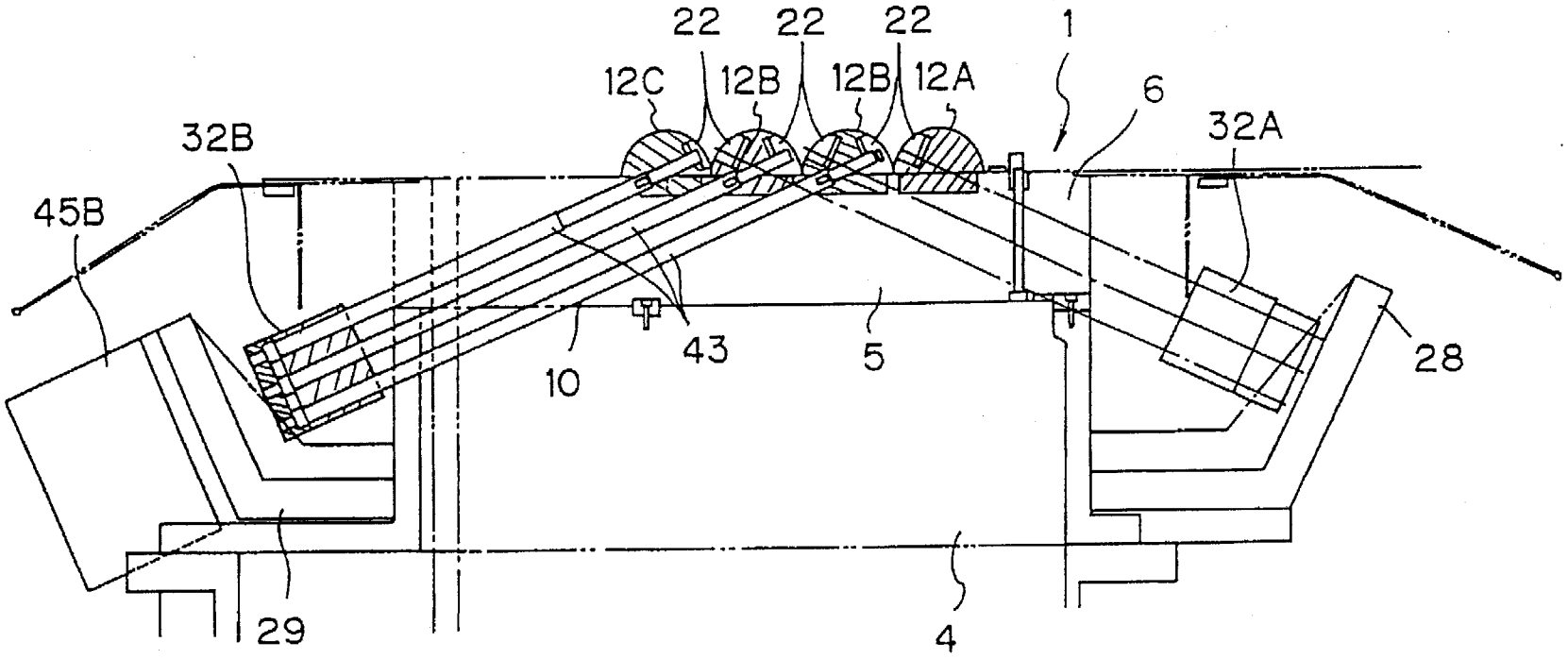
FIG. 4 is a partial cross-sectional view of the shell molding apparatus along line 4—4 of FIG. 2.

FIG. 1 is a partially cross-sectioned side view showing mainly the lower die of a shell molding apparatus according to the embodiment. FIG. 2 is a cross-sectional view along line 2—2 of FIG. 1. FIG. 3 is a partial cross-sectional view of the shell molding apparatus along line 3—3 of FIG. 2. FIG. 4 is a partial cross-sectional view of the shell molding apparatus along line 4—4 of FIG. 2.

The shell mold molding apparatus according to the present invention is mainly composed of a lower die 1 and an upper die 2. The lower die 1 has a die base 4 fixedly disposed on an apparatus base 3. A lower die heating block unit 5 is fixed on the die base 4. A shell molding insert structure 11 is mounted on the lower die heating block unit 5. The lower die heating block unit 5 and the shell molding insert structure 11 constitute the lower die unit.

Figure 6:
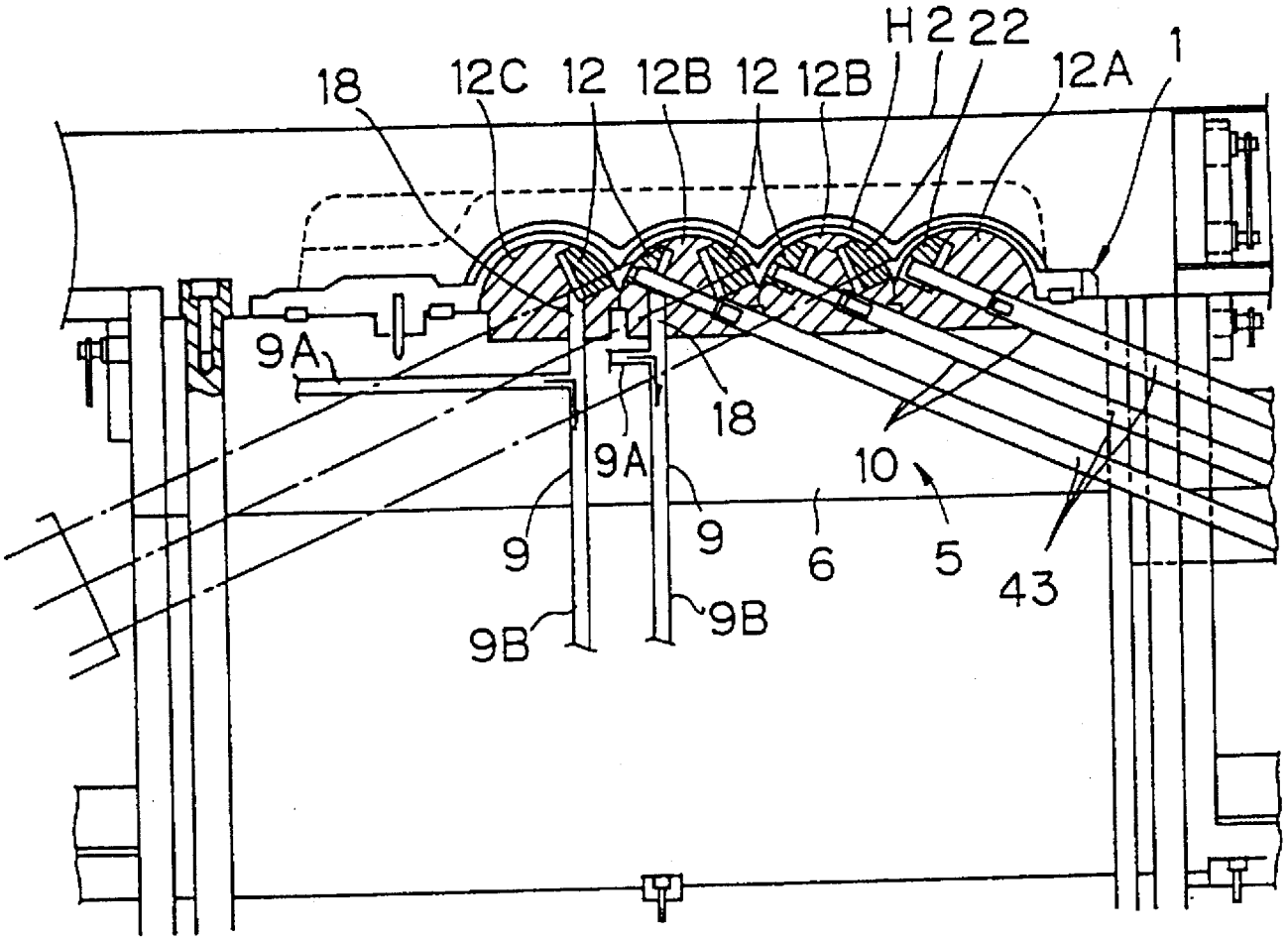
FIG. 6 is an enlarged view of portion D-1 of FIG. 3.
Figure 7:
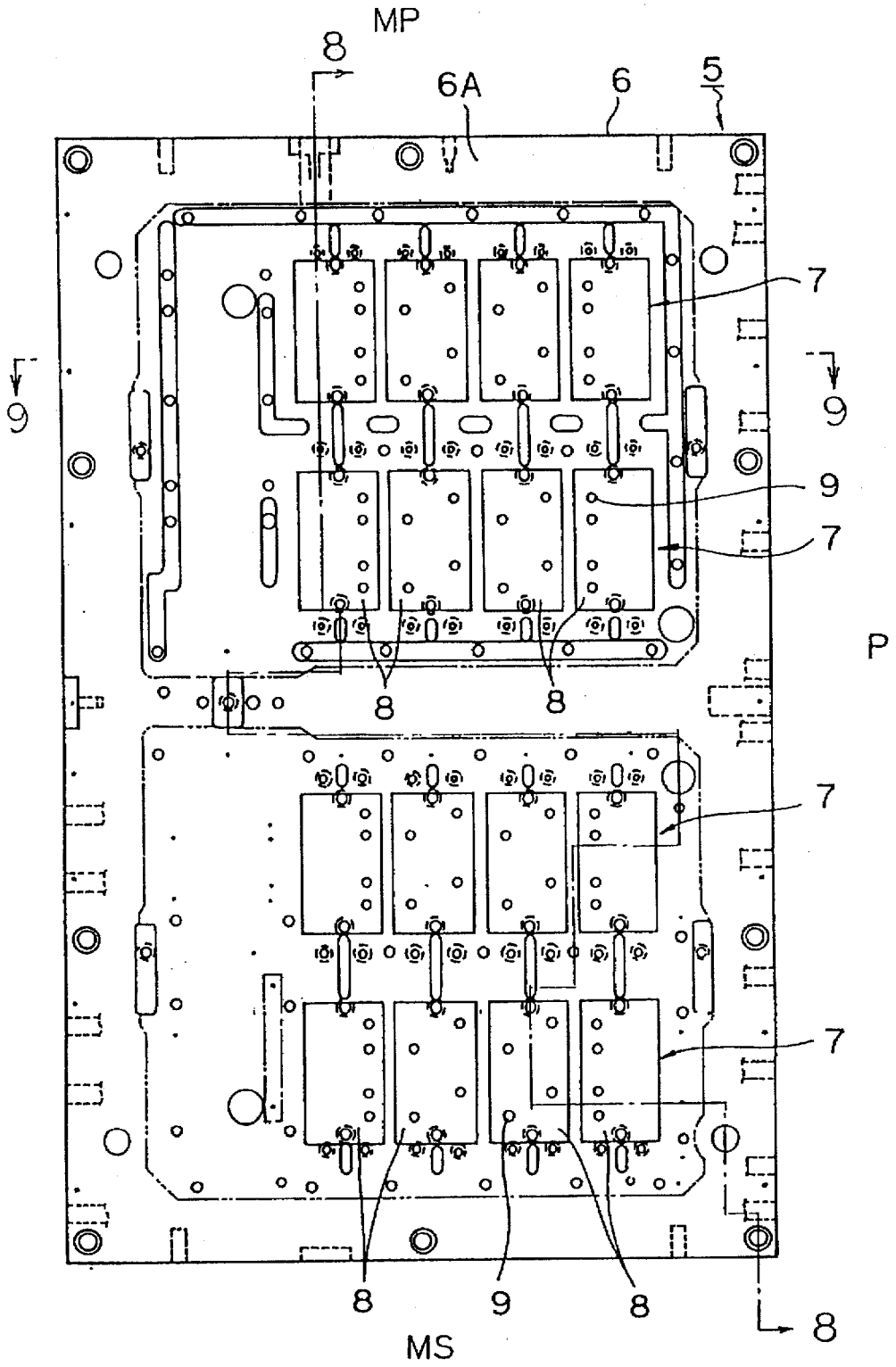
FIG. 7 is a plan view showing a lower die heating block unit.
Figure 8:
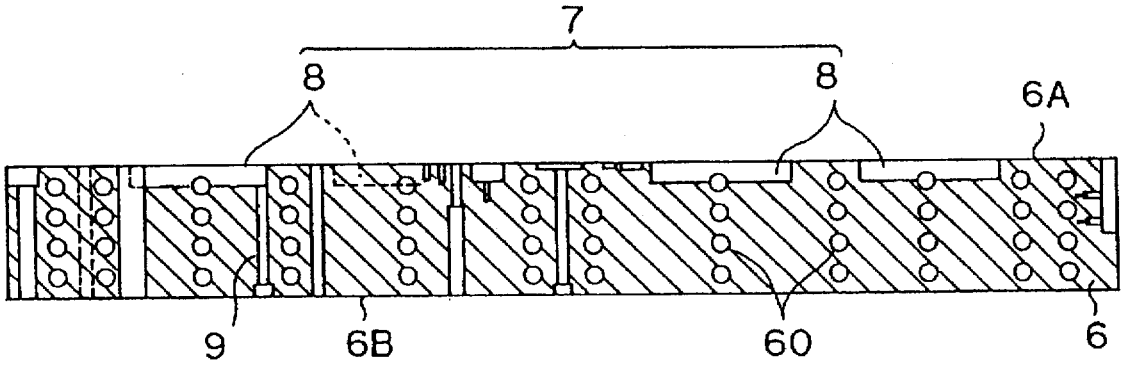
FIG. 8 is a cross-sectional view along line 8—8 of FIG. 7.
Figure 9:
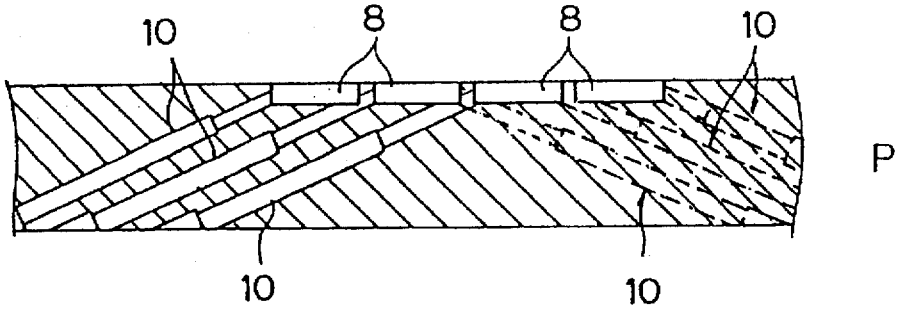
FIG. 9 is a cross-sectional view along line 9—9 of FIG. 7.
Figure 10:
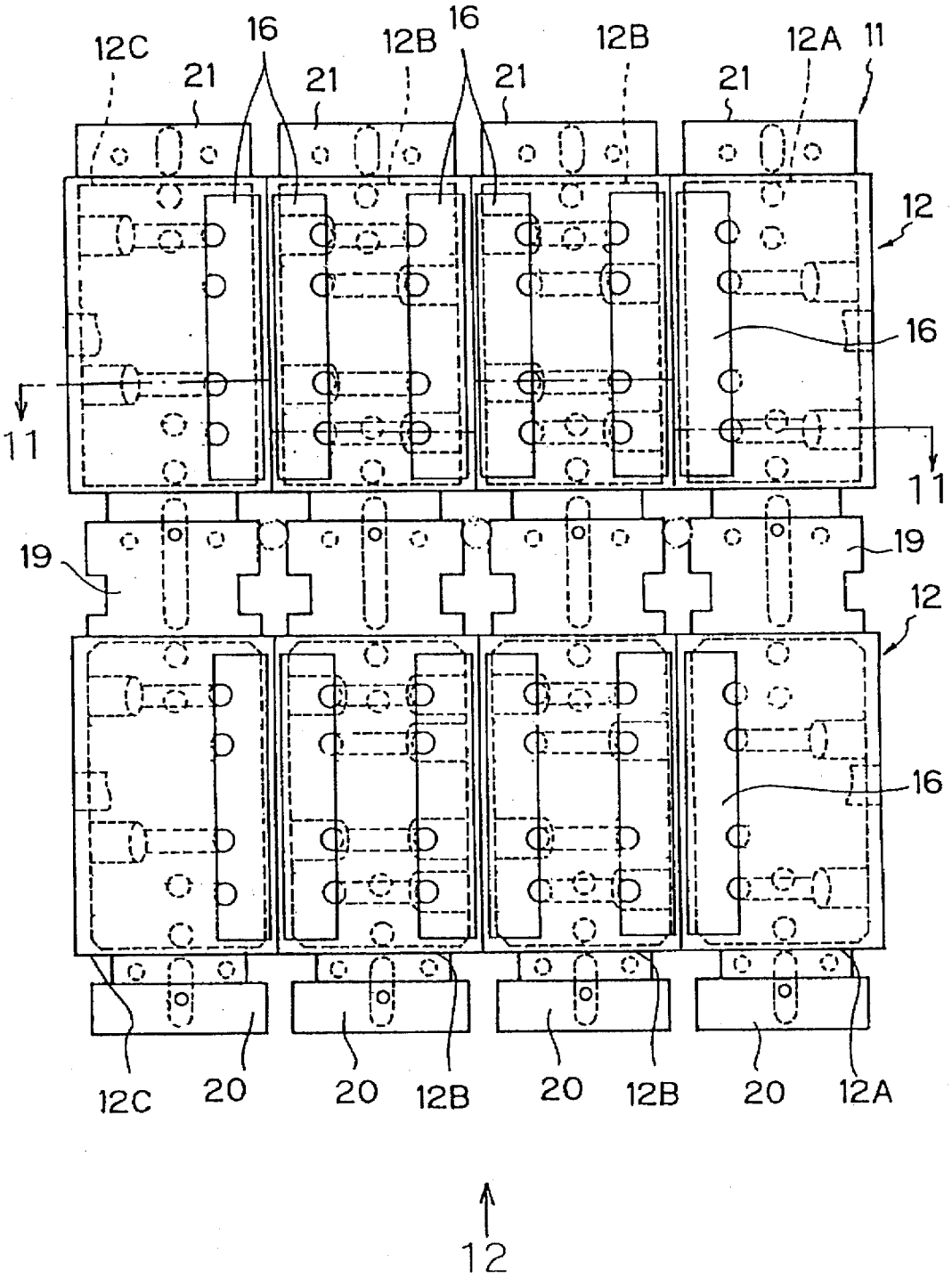
FIG. 10 is a plan view showing a shell molding insert structure.
Figure 11:
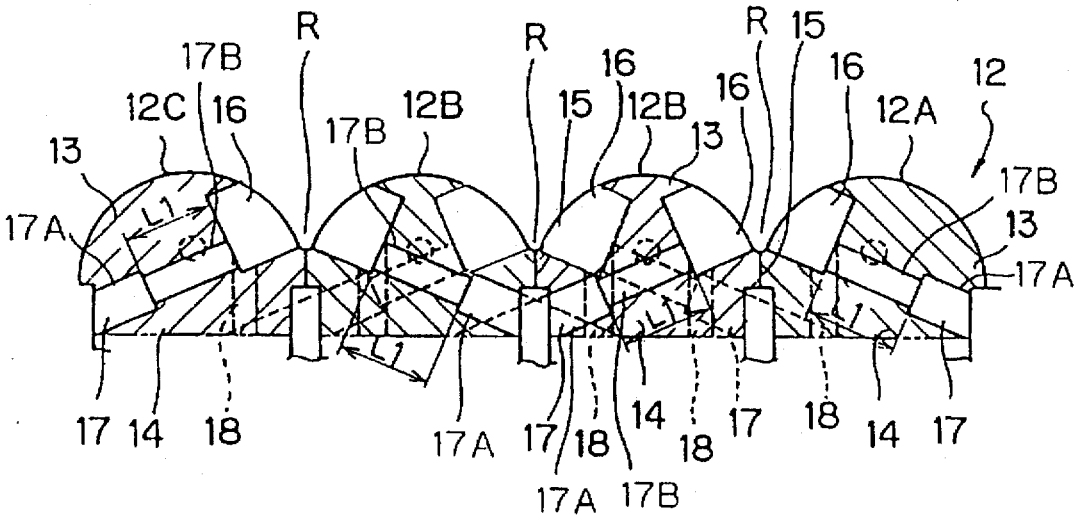
FIG. 11 is a cross-sectional view along line 11—11 of FIG. 10.
Figure 12:
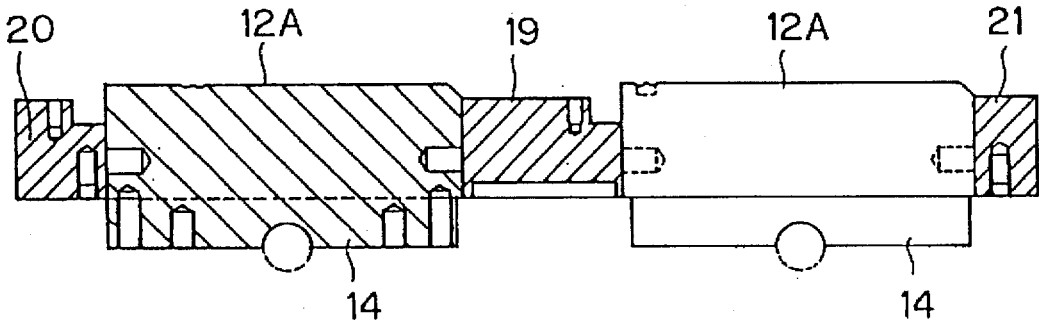
FIG. 12 is a partial cross-sectional view showing the shell molding insert structure as viewed in the direction of arrow 12 of FIG. 10.
Figure 13:
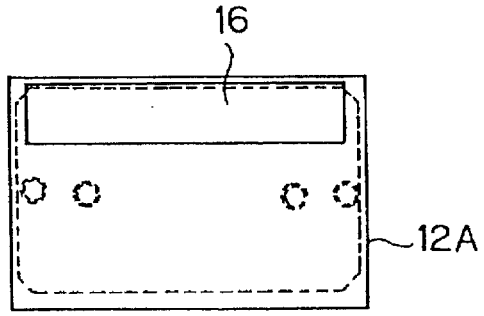
FIG. 13 is a plan view showing one shell molding insert.
Figure 14:
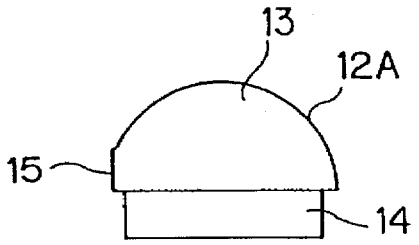
FIG. 14 is a side view of the shell molding insert of FIG. 13.
Figure 15:
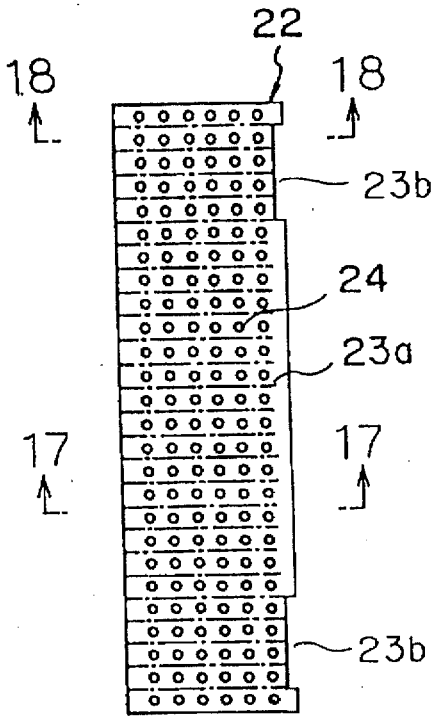
FIG. 15 is a plan view showing a spiny insert.
Figure 16:
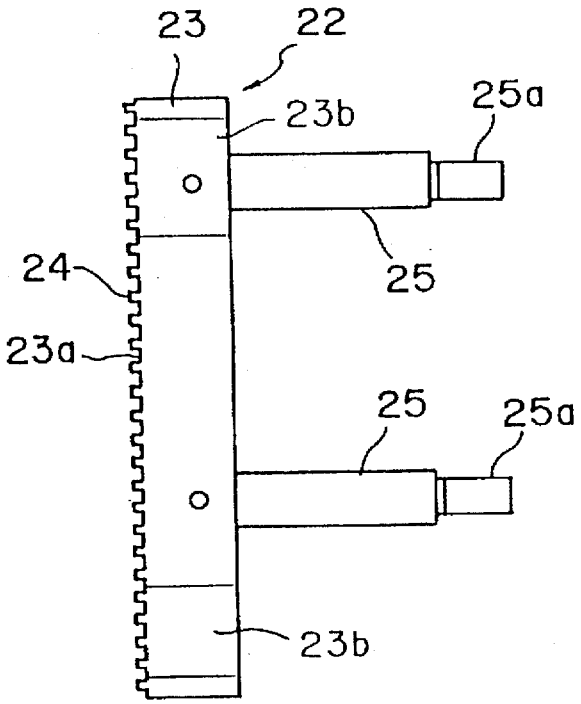
FIG. 16 is a side view of the spiny insert.
Figure 17:
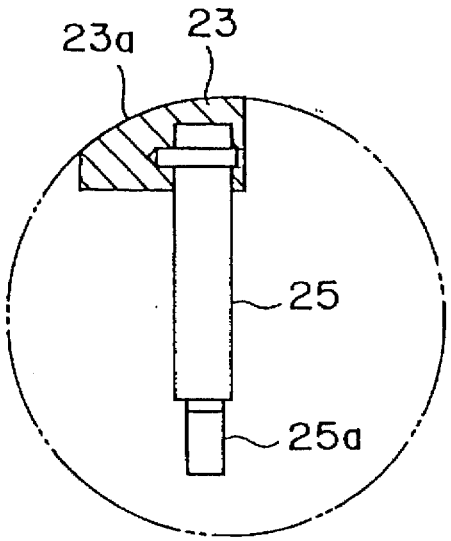
FIG. 17 is a cross-sectional view along line J—J of FIG. 15.
Figure 18:
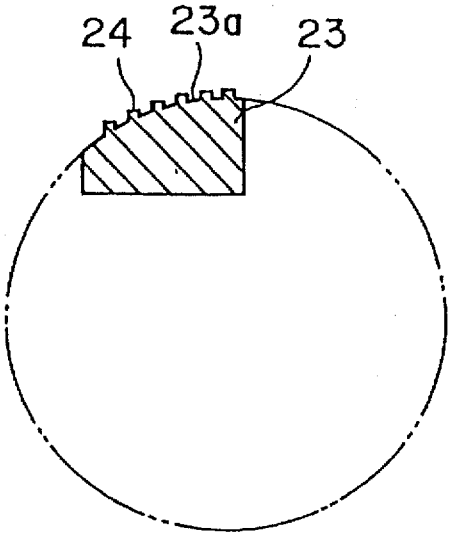
FIG. 18 is a cross-sectional view along line 18—18 of FIG. 15.

As shown in FIGS. 7 to 9, the lower die heating block unit 5 has a heating block 6 having a rectangular shape as viewed from above. Four groups 7 of insert receiving recesses are disposed in rows on the top surface 6A of the heating block 6, two rows on the left half side (MS side) and two rows on the right half side (MP side) as viewed from worker position P. Each group 7 of insert receiving recesses has four insert receiving recesses 8 disposed at a predetermined pitch in the front-rear direction as viewed from the worker position P. A plurality of sand release bores 9 are formed in the bottom portion of the insert receiving recesses 8 such that the sand release bores 9 extend through the heating block 6 to the bottom surface 6B thereof. Also, as shown in FIG. 6, air feed bores 9A are formed in the heating block 6 and connected to respective sand release bores 9.

For each group 7 of insert receiving recesses, three pin insertion bores 10 are formed in the heating block 6 obliquely upward from the front side (worker position P; hereinafter "front" refers to the side of the worker position P) to front-side three insert receiving recesses 8, and three pin insertion bores 10 are formed in the heating block 6 obliquely upward from the rear side (opposite to the worker position P; hereinafter "rear" refers to the side opposite to the worker position P) to rear-side three insert receiving recesses 8. Many heater insertion bores 60 are formed in right and left end portions of the heating block 6. Heaters 61 are inserted into the heater insertion bores 60 (see FIG. 1).

As shown in FIGS. 10 to 14, the shell molding insert structure 11 has two groups 12 of shell molding inserts in two rows, each group having four shell molding inserts. Each group 12 of shell molding inserts has a front-side shell molding insert 12A, two intermediate shell molding inserts 12B, and a rear-side shell molding insert 12C. The front-side shell molding insert 12A has an insert body 13 having a semicircular cross-section. The insert body 13 has a rectangular fitting portion 14 at the bottom portion thereof and a flat mating surface 15 at the rear side thereof. A spiny insert receiving recess 16 having a rectangular shape as viewed from above is formed in the insert body 13 at the rear portion thereof. Rod insertion bore portions 17 are formed in the insert body 13 such that they extend from the front surface of the fitting portion 14 to the bottom surface of the spiny insert receiving recess 16. Sand release bores 18 are formed in the insert body 13 such that they extend from the bottom surface of the spiny insert receiving recess 16 to the bottom surface of the fitting portion 14.

Each of the intermediate shell molding inserts 12B has an insert body 13 having a semicircular cross-section. The insert body 13 has a rectangular fitting portion 14 at the bottom portion thereof and a flat mating surface 15 at each of the front and rear sides thereof. A spiny insert receiving recess 16 having a rectangular shape as viewed from above is formed in the insert body 13 at each of the front and rear portions thereof. Rod insertion bore portions 17 are formed in the insert body 13 such that they extend from the front surface of the fitting portion 14 to the bottom surface of the rear-side spiny insert receiving recess 16. Also, rods insertion bore portion 17 are formed in the insert body 13 such that they extend from the rear surface of the fitting portion 14 to the bottom surface of the front-side spiny insert receiving recess 16. Sand release bores 18 are formed in each insert body 13 such that they extend from each spiny insert receiving recess 16 to the bottom surface of the corresponding fitting portion 14.

The front-side shell molding insert 12C has an insert body 13 having a semicircular cross-section. The insert body 13 has a rectangular fitting portion 14 at the bottom portion thereof and a flat mating surface 15 at the front side thereof. A spiny insert receiving recess 16 having a rectangular shape as viewed from above is formed in the insert body 13 at the front portion thereof. Rod insertion bore portions 17 are formed in the insert body 13 such that they extend from the rear surface of the fitting portion 14 to the bottom surface of the spiny insert receiving recess 16. Sand release bores 18 are formed in the insert body 13 such that they extend from the spiny insert receiving recess 16 to the bottom surface of the fitting portion 14.

In the front-side, intermediate, and rear-side shell molding inserts 12A, 12B, and 12C, each rod insertion bore portion 17 is composed of a larger-diameter bore portion 17A and a smaller-diameter bore portion 17B located on the side of the spiny insert receiving recess 16 while a stepped stop end 17C is formed therebetween. The shell molding inserts are all identical in length L1 of the smaller-diameter bore portion 17B.

The group 12 of four shell molding inserts is mounted in the group 7 of four insert receiving recesses provided in the lower die heating block unit 5. That is, the front-side shell molding insert 12A is fitted into the front-side insert receiving recess 8 of the group 7 of four insert receiving recesses and then fixed using bolts. Likewise, the intermediate shell molding inserts 12B are fitted into the intermediate insert receiving recesses 8 of the group 7. The rear-side shell molding insert 12C is also fitted into the rear-side insert receiving recess 8 of the group 7.

Adjacent shell molding inserts 12A, 12B, and 12C contact each other at the mating surfaces 15. The spiny insert receiving recess 16 is formed at each undercut portion R which is formed by adjacent curved surfaces of the adjacent shell molding inserts 12A, 12B, and 12C. The sand release bores 18 extending from the spiny insert receiving recesses communicate with the sand release bores 9 provided in the lower die heating block unit 5.

The rod insertion bore portions 17 in the front-side shell molding insert 12A and the front-side rod insertion bore portions 17 in each of two intermediate shell molding inserts 12B communicate with front-side three pin insertion bores 10 provided in the lower die heating unit 5. Likewise, the rod insertion bore portions 17 in the rear-side shell molding insert 12C and the rear-side rod insertion bore portions 17 in each of two intermediate shell molding inserts 12B communicate with rear-side three pin insertion bores 10 provided in the lower die heating unit 5. The sand release bores 18 are connected to the sand outlet bores 9B. The sand release bores 18 and 9, the air feed bores 9A, and sand outlet bores 9B provided in the die base 3 constitute sand releasing means.

Spacer blocks 19 are disposed between two rows of groups 12 of shell molding inserts, i.e. between the opposed end surfaces of the opposed shell molding inserts 12A, of the opposed shell molding inserts 12B, and of the opposed shell molding inserts 12C. The spacer blocks are fixed on the lower die heating block unit 5 using bolts. The shell molding inserts 12A, 12B, and 12C in a right-hand group 12 as viewed from the worker position P are fixed at their right-hand ends using right-hand end holding members 20. Likewise, the shell molding inserts 12A, 12B, and 12C in a left-hand group 12 as viewed from the worker position P are fixed at their left-hand ends using left-hand end holding members 21. The right- and left-hand end holding members 20 and 21 are fixed on the lower die heating block unit 5 using bolts.

The spiny inserts 22 are inserted into the spiny insert receiving recesses 16 such that they are allowed to project from the recesses and retract thereinto. As shown in FIGS. 15 to 18, each spiny insert 22 has an insert body 23. The curved surface **23*a* of the insert body 23 has the same curvature as the curved surfaces of the front-side, intermediate, and rear-side shell molding inserts 12A, 12B, and 12C. Many protrusions 24 are formed on the curved surface 23*a*. The insert body 23 is provided with two rods 25, and end of each rod 25 is formed into a threaded portion 25*a***.

The thus manufactured spiny insert 22 is retractably inserted into the spiny insertion recess 16 while the rods 25 thereof are inserted into the rod insertion bore portions 17.

As shown in FIG. 1, right and left (as viewed from the worker position P) slide block positioning arms 26 are fixed to the die base 4 at the front side thereof, and right and left slide block positioning arms 27 are fixed to the die base 4 at the rear side thereof. As shown in FIG. 3, a cylinder holding member 28 is fixed to the die base 4 at the intermediate portion of the front side thereof, and a cylinder holding member 29 is fixed to the die base 4 at the intermediate portion of the rear side thereof. Each of the front-side right and left slide block positioning arms 26 has a pair of support portions 30, in which pin bores 31 are formed. The front-side (one side) right and left slide block positioning arms 26 hold in place the front-side (one side) slide block 32A.

Figure 5:
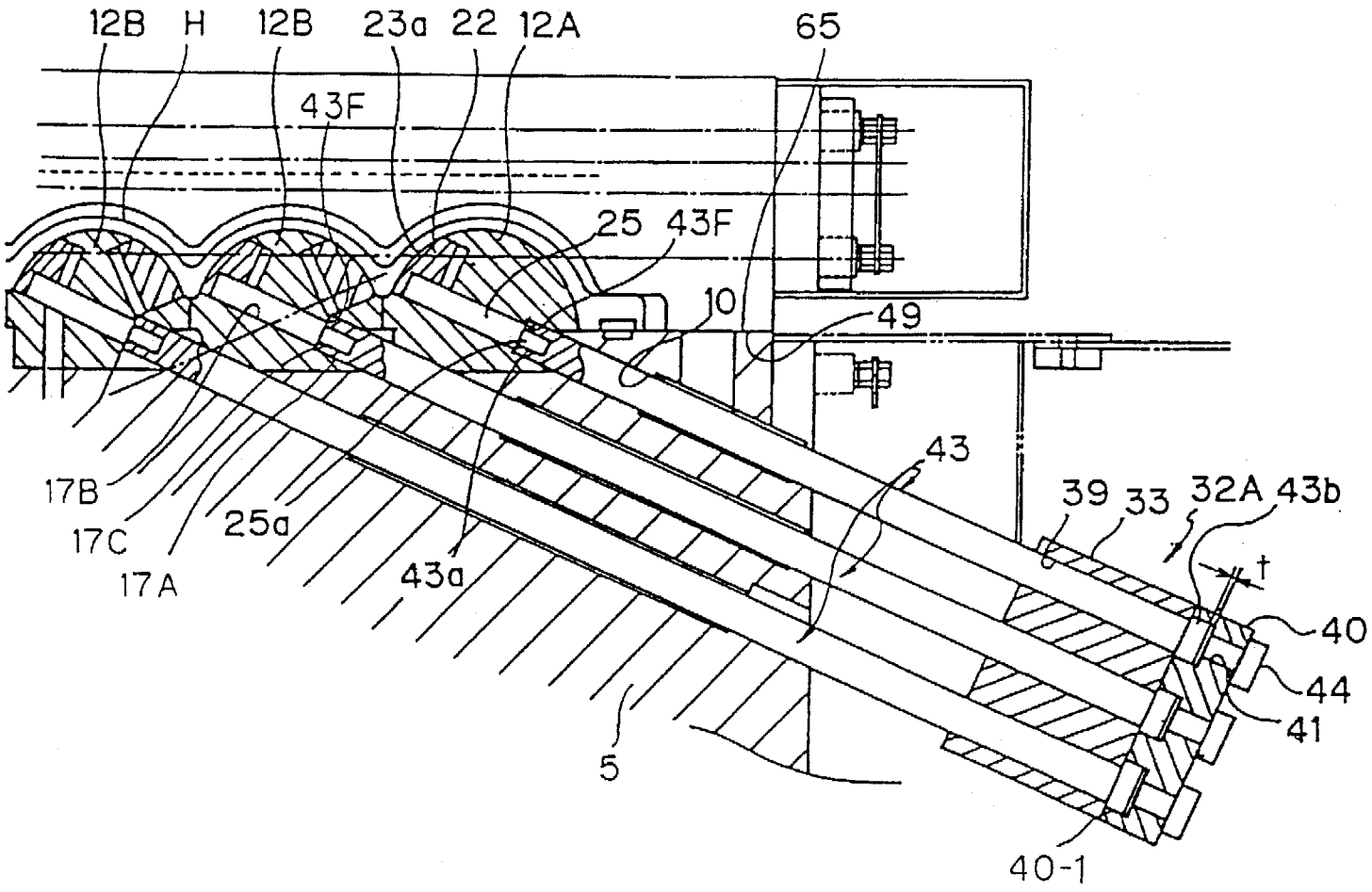
FIG. 5 is an enlarged view showing portion D of FIG. 3.
Figure 19A:
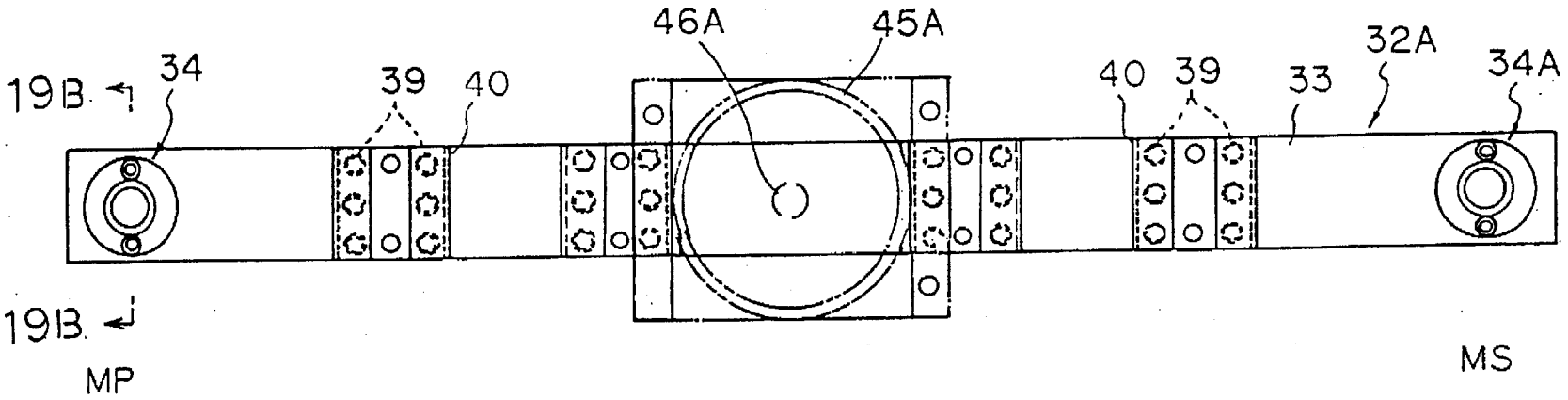
FIG. 19A is a front view showing a slide bock mechanism.
Figure 19B:
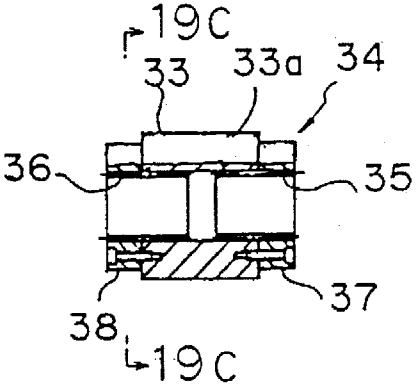
FIG. 19B is a partial cross-sectional view along line 19B—19B of FIG. 19A.
Figure 19C:
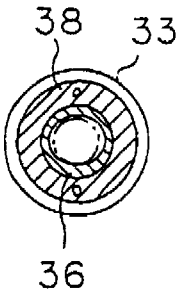
FIG. 19C is a cross-sectional view along line 19C—19C of FIG. 19B.
Figure 20A:
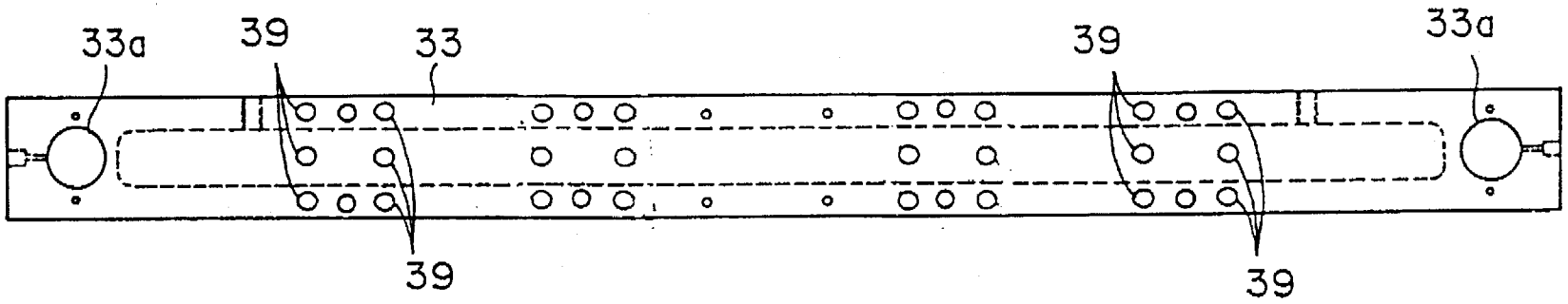
FIG. 20A is a front view showing a slide block.
Figure 20B:
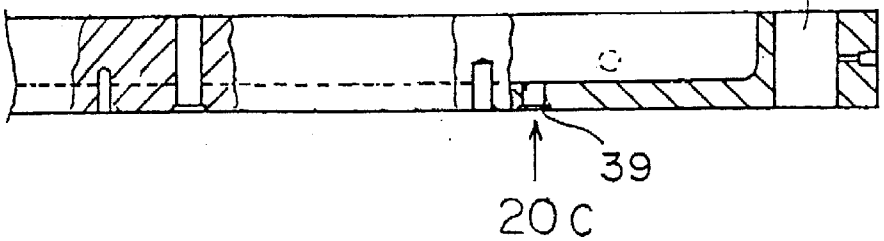
FIG. 20B is a cross-sectional view of the slide block with part thereof omitted.
Figure 20C:
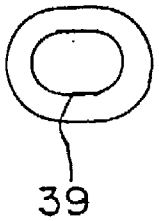
FIG. 20C is a view in the direction of arrow 20C of FIG. 20B.
Figure 21:
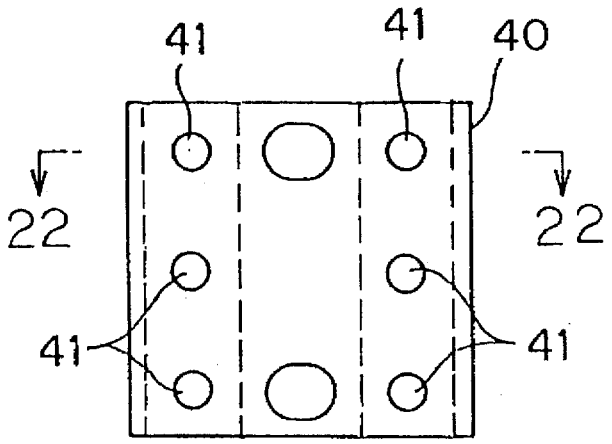
FIG. 21 is a plan view showing a pin receiving member.
Figure 22:
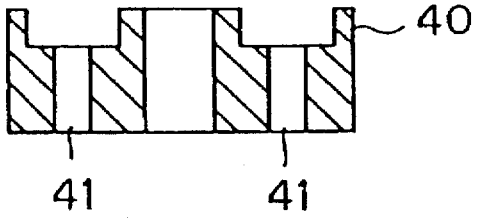
FIG. 22 is a cross-sectional view along line 22—22 of FIG. 21.
Figure 23:
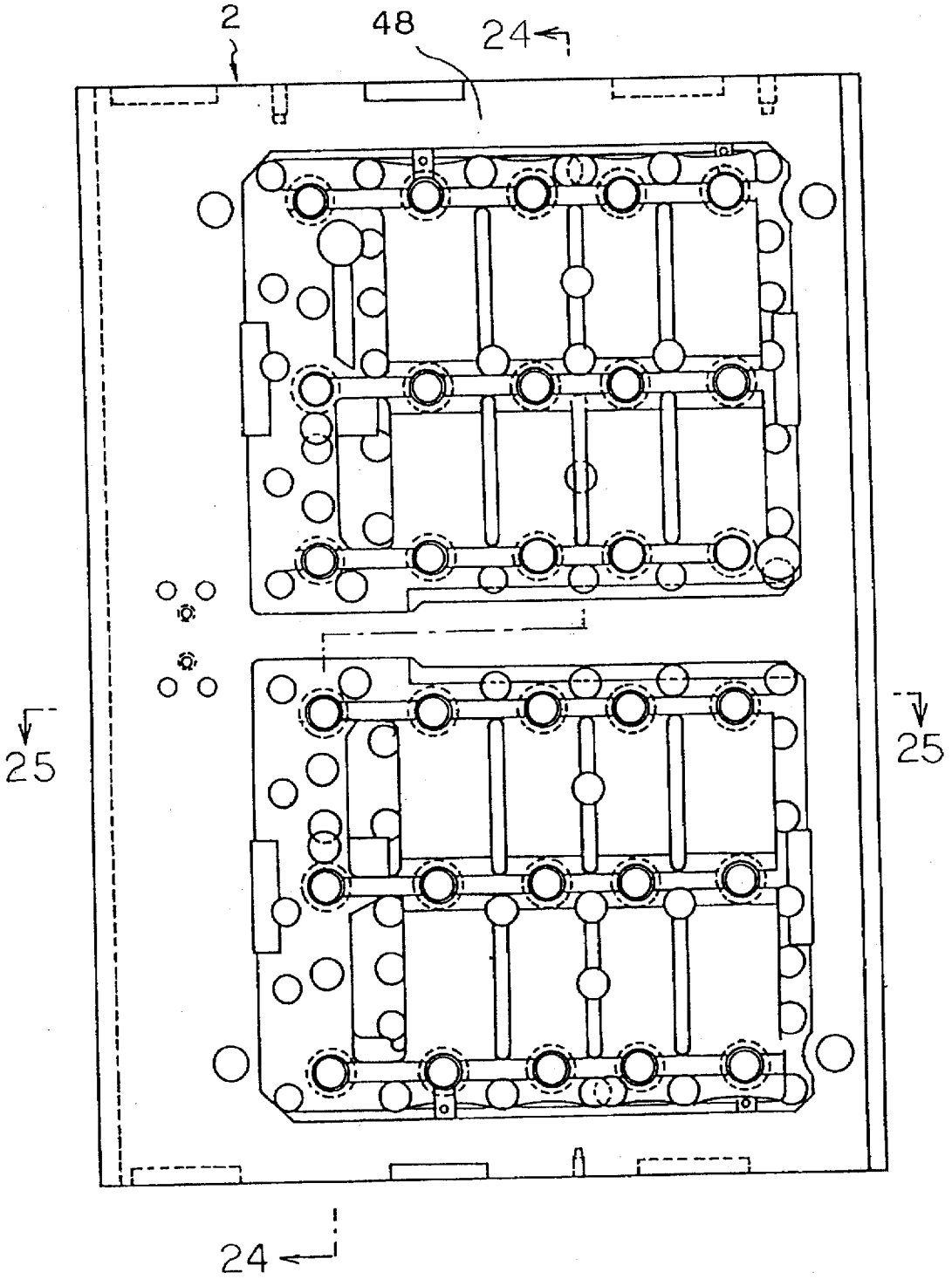
FIG. 23 is a plan view showing an upper die.
Figure 24:
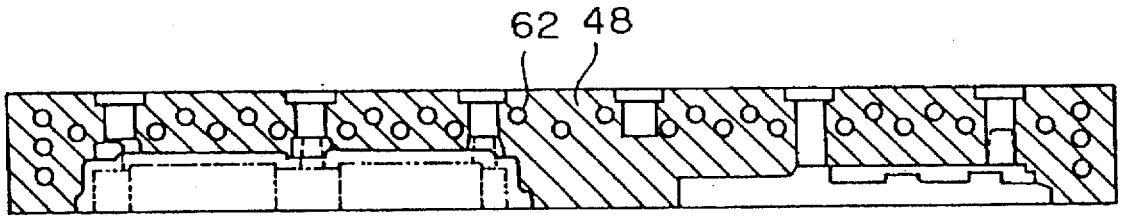
FIG. 24 is a cross-sectional view along line 24—24 of FIG. 23.
Figure 25:
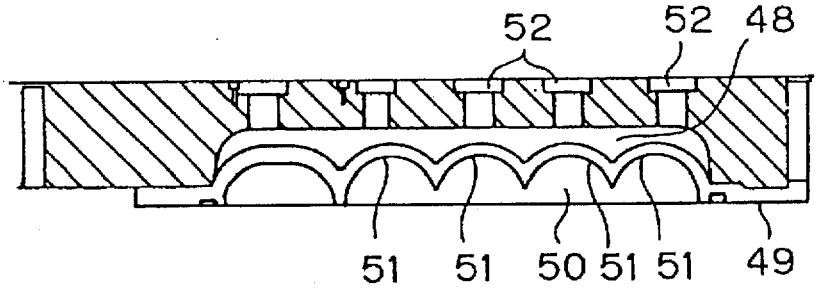
FIG. 25 is a cross-sectional view along line 25—25 of FIG. 23.

As shown in FIGS. 19A and 20A, the slide block 32A has a long block member 33 having a rectangular cross-section. A pin sliding mechanism 34 is provided at each of both end portions of the block member 33. The pin sliding mechanism 34 has a structure in which guide bushings 35 and 36 are inserted into a bore 33*a* formed in the block member 33 and that the guide bushings 35 and 36 are held in place by the bushing holders 37 and 38. Two groups of pin insertion bores 39, each having three bores, are formed in parallel with each other in the block member 33 on the right and left sides with respect to the central portion of the block member 33. As shown in FIG. 5, a pin receiving member 40 is fixed to the block member 33 behind the pin insertion bores 39. Threaded bores 41 are formed in the pin receiving member 40 such that they face the end portions of the pin insertion bores 39.

The slide block 32A having the above-described structure is held by the front-side right and left slide block positioning arms 26 while the guide bushings 35 and 36 of the pin sliding mechanism 34 are slidably fitted to slide pins 42 which are supported by a pair of support portions 30.

The guide bushings 35 and 36 have a horizontally oblong cross-section so as to allow the slide pin 42 to horizontally move within the guide bushings 35 and 36 whereby lower die thermal expansion absorbing means is formed.

As shown in FIG. 5, each of withdrawal pins 43 has a threaded bore 43*a* at the tip end thereof and a polygonal (octagonal) flange 43*b* at the base end thereof. The withdrawal pins 43 are inserted into the pin insertion bores 39 of the slide block 32 and into the pin insertion bores 10 of the lower die heating block unit 5. The threaded portions 25*a* of the rods 25 of each spiny insert 22 are screwed into the threaded bores 43*a* of the withdrawal pins 43, whereby the withdrawal pins 43 are engaged with the spiny insert 22. A stopper portion 43F is formed between the rod 25 and the end portion of the withdrawal pin 43. In order to prevent the rotation between the rods 25 and the withdrawal pins 43, polygonal (octagonal) washers 40-1 are inserted into the pin receiving member 40.

Since the pin insertion bores 39 have a horizontally oblong cross-section, the withdrawal pins 43 can move within the corresponding pin insertion bores 39, whereby slide block thermal expansion absorbing means is established.

The stepped stop end 17C is provided in each of the rod insertion bores 17 provided in the shell molding inserts 12A, 12B, and 12C. The stopper portion 43F, i.e. the end portion of the withdrawal pin 43 abuts against the stepped stop end 17C. The portion of the rod insertion bore portion 17 extending from the stepped stop end 17C toward the spiny insert receiving recess 16 forms the smaller-diameter portion 17B. The shell molding inserts 12A, 12B, and 12C are identical in the length L1 of the smaller-diameter bore portion 17B. In this way, stopper means are established at positions which are free from thermal expansion of the withdrawal pins 43.

Adjusting bolts 44 are screwed into the threaded bores 41 of the pin receiving members 40, and a spacing "t" is formed between the end surfaces of the adjusting bolts 44 and the end surfaces of the flanges 43*b* of the withdrawal pins 43 so as to absorb variations in length of the withdrawal pins 43 caused by thermal expansion. In this way, thermal expansion absorbing means for the withdrawal pins 43 is established.

A front-side (one side) actuator cylinder 45A is mounted to the front-side (one side) cylinder holding member 28, and the piston rod 46A of the actuator cylinder 45A is fixed to the slide block 32A at the central portion thereof. The actuator cylinder 45A, the slide block 32A, and the withdrawal pins 43 constitute front-side spiny insert actuating means.

The rear-side (the other side) slide block 32B has the same structure as the front-side slide block 32A as described below. As in the front-side slide block 32A, the rear-side (the other side) slide block 32B is held in place by right and left slide block positioning arms 27. Withdrawal pins 43 are inserted into pin insertion bores 39 of the slide block 32B and into the pin insertion bores 10. The threaded portions 25*a* of the rods 25 of the spiny insert 22 are screwed into the threaded bores 43*a* of the withdrawal pins 43, whereby the withdrawal pins 43 are engaged with the spiny insert 22.

A rear-side (the other side) actuator cylinder 45B is mounted to the rear-side (the other side) cylinder holding member 28, and the piston rod (not shown) of the actuator cylinder 45B is fixed to the slide block 32B at the central portion thereof. The actuator cylinder 45B, the slide block 32B, and the withdrawal pins 43 constitute rear-side spiny insert actuating means.

As shown in FIG. 2, a plurality of eject pin bores 46 are formed in the apparatus base 3, the die base 4, and the lower die heating block unit 5. Eject pins 47 are inserted into the eject pin bores 46. The eject pins 47 are linked together and moved vertically by an ejecting lift mechanism (not shown), thus forming eject means.

The upper die 2 has an upper die unit 48, in which, as shown in FIGS. 23 to 32, a die parting face 49 of a cavity 50 is formed. The cavity is formed of a plurality of continuous recesses 51 corresponding to the shell molding inserts 12A, 12B, and 12C of the lower die 1. The upper die unit 48 is provided with gates 52, each communicating with each of the recesses 51. Many heater insertion bores 62 are formed through the upper die unit 48 in the front-rear direction, and heaters 63 are inserted into the bores. The upper die 2 is moved vertically by a lift mechanism (not shown).

How a shell mold is molded by the shell molding apparatus having the above-described structure will now be described.

The actuator cylinders 45A and 45B of the lower die 2 are expanded to move (advance) the slide blocks 32A and 32B to thereby moving the withdrawal pins 43 until the end surfaces 43F of the withdrawal pins 43 abut against the stepped stop ends 17C of the rod insertion bore portions 17. As a result, the spiny inserts 22 engaged with the withdrawal pins 43 advance, so that the curved surfaces 23*a* of the spiny inserts 22 coincide with the surfaces of the front-side, intermediate, and rear-side shell molding inserts 12A, 12B, and 12C. Thus, many protrusions 24 on the curved surfaces 23*a* project.

Next, the abovementioned lift mechanism operates to lower the upper die 2 until the parting face 49 of the upper die unit 48 and the parting face 65 of the lower die unit 64 mate each other. As a result, the shell molding inserts 12A, 12B, and 12C are inserted into corresponding recesses 51 of the cavity 50, whereby a space H having the shape of a sand mold to be molded is formed between the shell molding inserts and the recesses.

Then, shell sand (mixture of silica sand and thermosetting polymeric material) is charged into the space H through the plurality of gates 52 provided in the upper die unit 48.

Next, the heaters 61 and 63 provided in the upper and lower dies 1 and 2 are energized to heat the upper and lower die units 48 and 64 and shell molding inserts 12A, 12B, and 12C to a temperature of about 350° C. As a result, the shell sand hardens to form the shell mold 70.

Then, the heaters 61 and 63 are de-energized. The upper die 2 is raised by the lift mechanism to part the upper die 2 from the lower die 1. In this state, the shell mold 70 is attached to the shell molding inserts 12A, 12B, and 120 of the lower die 1.

Next, the actuator cylinders 45A and 45B of the lower die 2 are contracted to retreat the slide blocks 32A and 32B to thereby retract the spiny inserts 22 via the withdrawal pins 43. This retracts the curved surfaces **23*a* of the spiny inserts 22 from the surfaces of the front-side, intermediate, and rear-side shell molding inserts 12A, 12B, and 12C, thereby parting many protrusions 24 provided on the curved surfaces 23*a* from the shell mold 70. When the protrusions 24 are about 2 mm long, the amount of retraction of the spiny inserts 22** is about 5 mm.

Then, the ejector lift mechanism operates to raise the eject pins 47 to push up the shell mold 70 to part it from the lower die 1. The obtained shell mold 70 is half of a required shell mold and is provided, at the undercut portions on the inner surface thereof, with many depressions which are formed by reversely copying many protrusions 24 of the spiny inserts 22.

Figure 26:
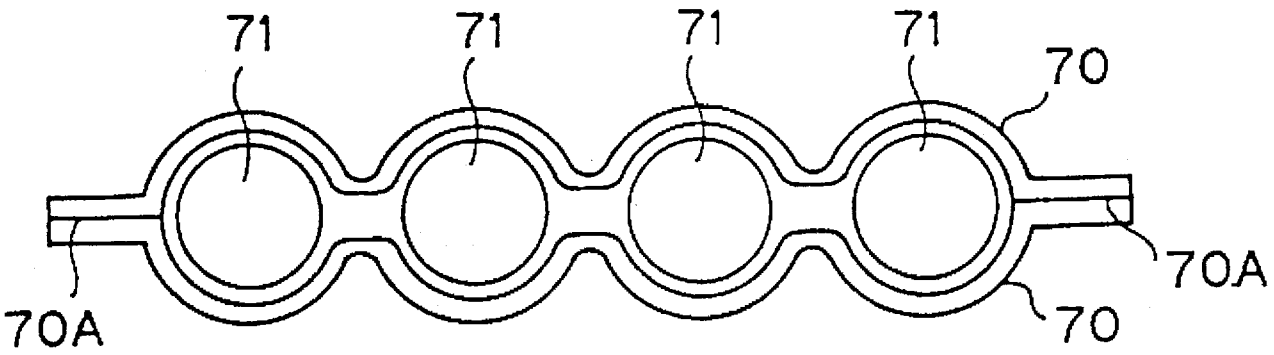
FIG. 26 is a plan view showing a shell mold composed of halved shell molds and bore forming inserts placed therebetween.

At the subsequent step, as shown in FIG. 26, two halved shell molds 70 are engaged each other by bonding them at mating surfaces 70A while four bore forming cores 71 are placed therebetween.

Figure 27:
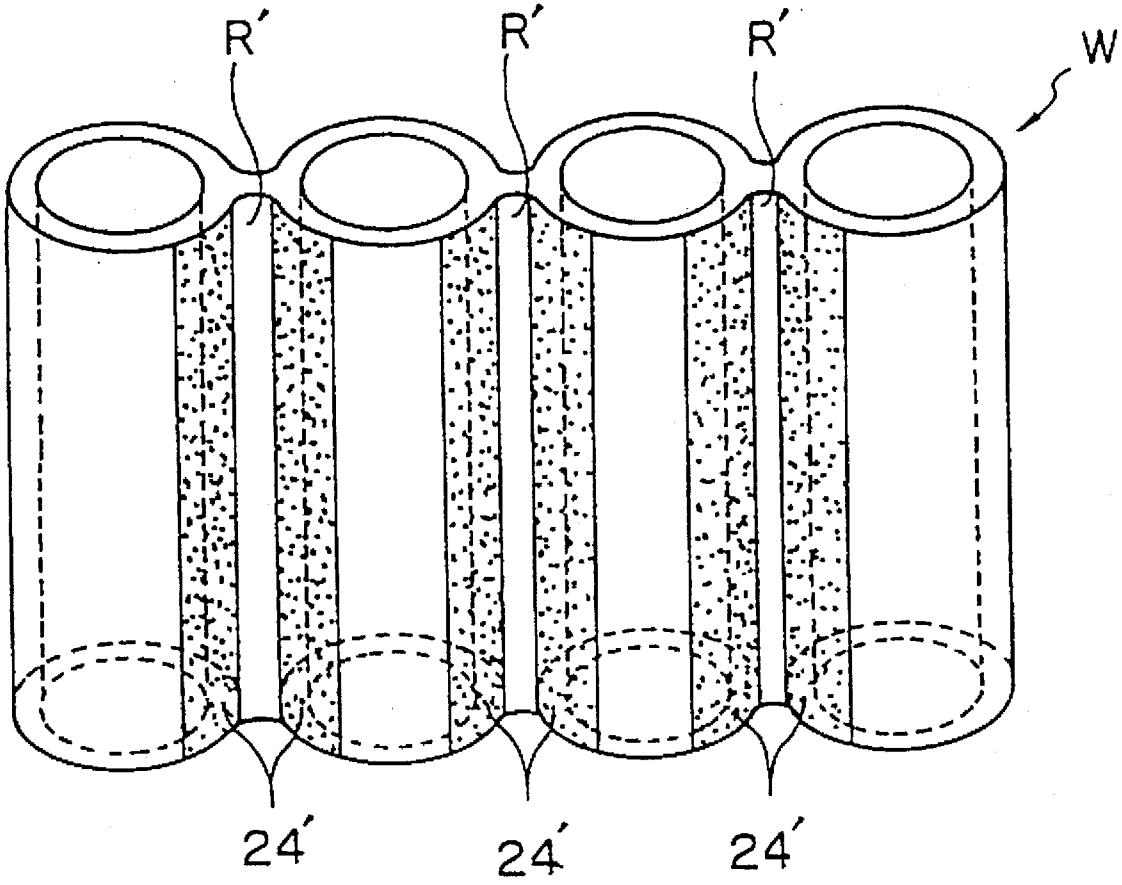
FIG. 27 is a perspective view showing a quadruple sleeve.
Figure 28:
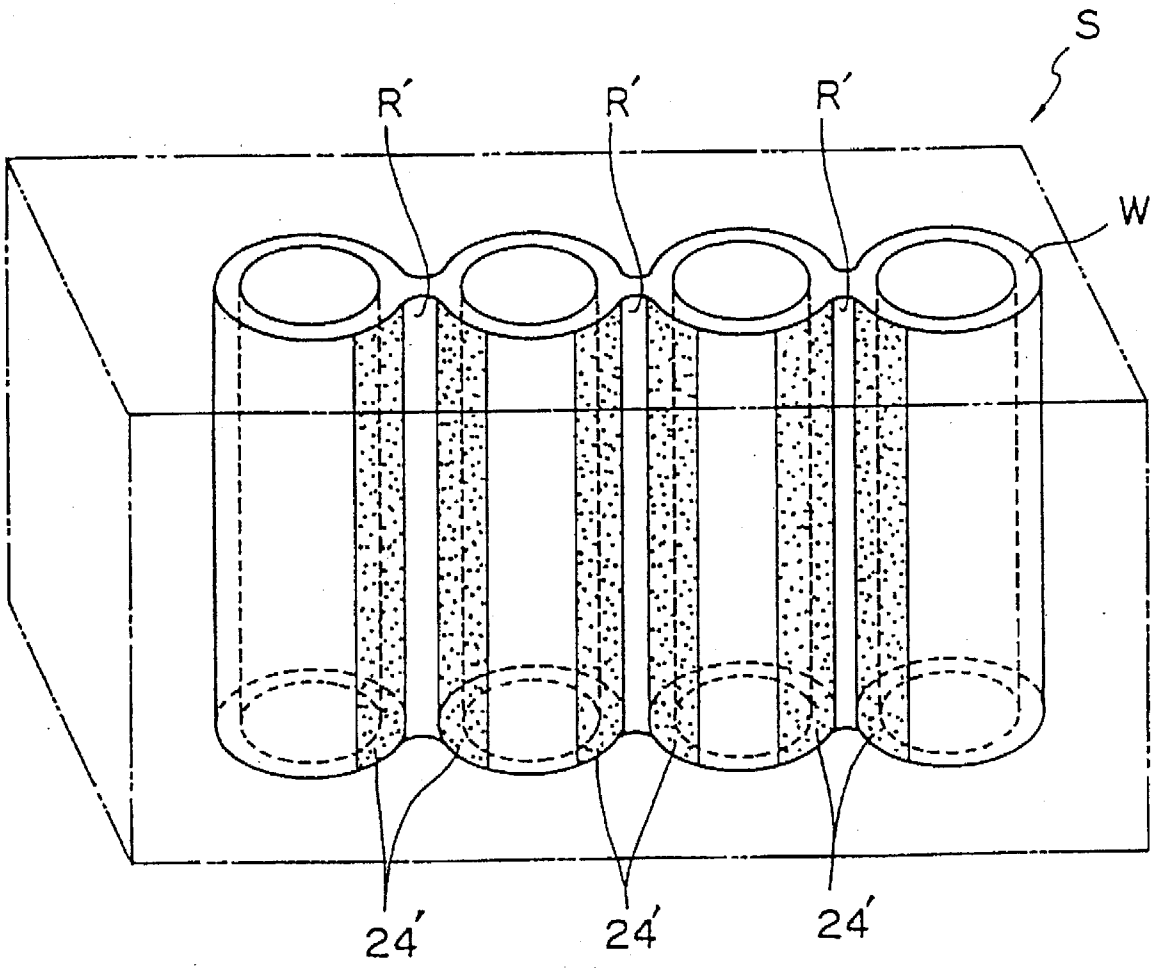
FIG. 28 is a perspective view showing a cylinder block.
Figure 29:
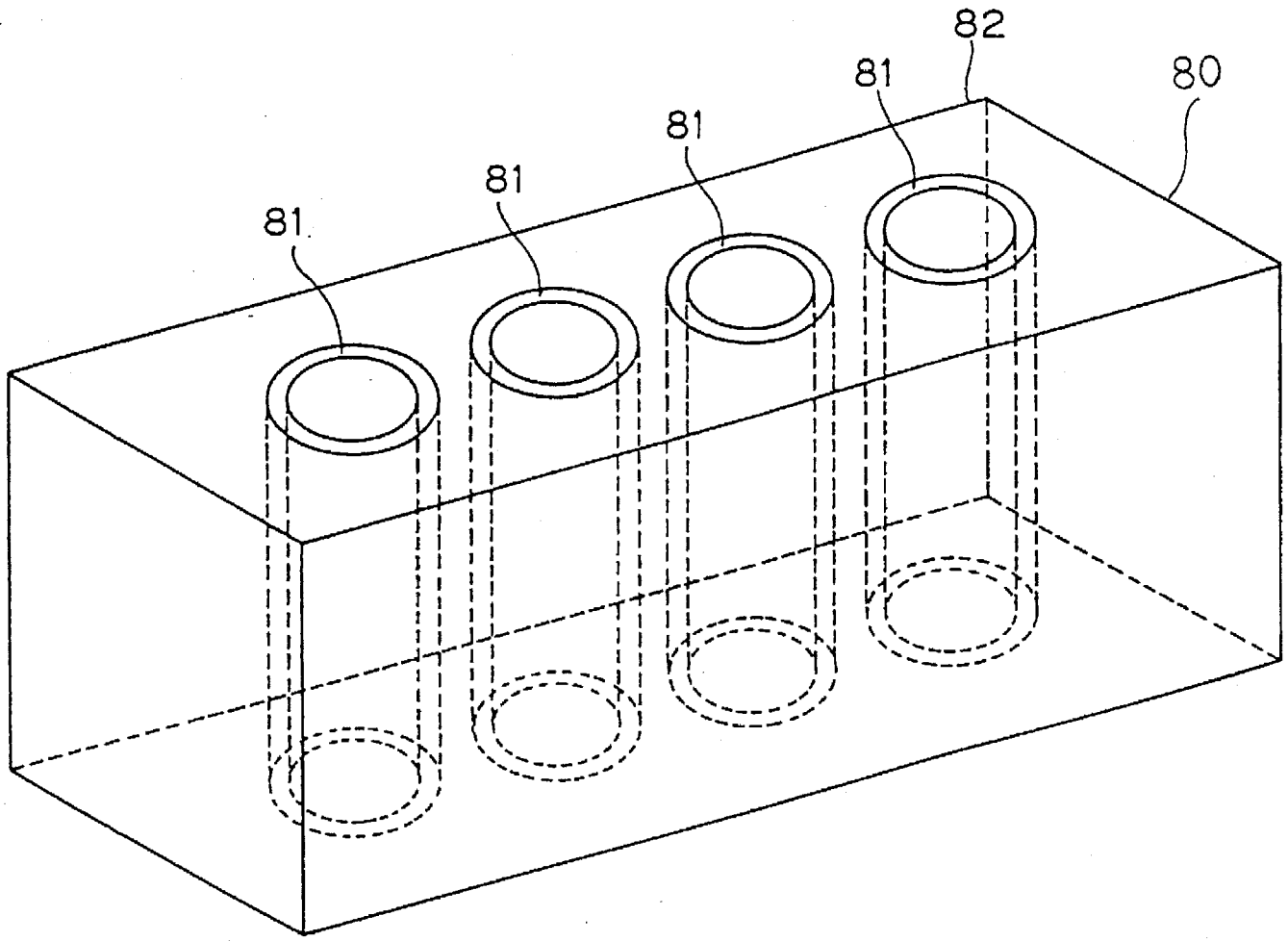
FIG. 29 is a perspective view showing a conventional cylinder block.

The shell mold is transferred to a casting site, where molten aluminum alloy is poured into the shell mold to cast a quadruple-sleeve W shown in FIG. 27. Many protrusions 24' are formed on the sleeve W at undercut portions R' thereof. In a subsequent aluminum die casting, the sleeves W are embedded in an aluminum alloy so as to manufacture a cylinder block S shown in FIG. 28.

According to the above-described embodiment, the stepped stop end 17C is provided in each of the rod insertion bores 17 provided in the shell molding inserts 12A, 12B, and 12C. The stopper portion 43F, i.e. the end portion of the withdrawal pin 43 abuts against the stepped stop end 17C. The portion of the rod insertion bore portion 17 extending from the stepped stop end 17C toward the spiny insert receiving recess 16 forms the smaller-diameter portion 17B. The shell molding inserts 12A, 12B, and 12C are identical in the length L1 of the smaller-diameter bore portion 17B. Accordingly, it is possible to position the withdrawal pins 43 at locations where they equally move due to thermal expansions.

Also, adjusting bolts 44 are screwed into the threaded bores 41 in the pin receiving members 40 while spacing "t" is formed between the end surfaces of the adjusting bolts 44 and the end surfaces of the flanges **43*b* of the withdrawal pins 43 so as to absorb variations in length of the withdrawal pins 43 caused by thermal expansion. Accordingly, it is possible to absorb variations in length of the withdrawal pins 43 caused by thermal expansion even when the withdrawal pins 43** are all different in length.

Further, for example, as a result of the lower die heating block unit 5 being heated to about 360° C. and the slide blocks 32A and 32B and the slide block positioning arms 26 and 27 being heated to about 100° C., a difference in thermal expansion is produced between the lower die heating block unit 5 and the slide blocks 32A and 32B and the slide block positioning arms 26 and 27. The thermal expansion differential, however, is absorbed by the proposed lower die thermal expansion absorbing means having the following structure. The guide bushings 35 and 36 of the slide blocks 32A and 32B into which the slide pins 42 are slidably inserted have an oblong cross-section so that the slide pins 42 can move within the guide bushings 35 and 36.

Also, the slide block thermal expansion absorbing means is formed such that the pin insertion bores 39 provided in the slide blocks 32A and 32B have an oblong cross-section, thereby allowing the withdrawal pins 43 to move within the respective pin insertion bores 39. Accordingly, the thermal expansion differential between the slide blocks 32A and 32B and the lower die heating block unit 5 while they are heated as described above is absorbed by the relative movement of the withdrawal pins 43 within the oblong pin insertion bores 39.

Further, when a shell mold is molded, shell sand tends to enter between the spiny insert receiving recesses 16 and the spiny inserts 22 and hinder the movement of the spiny inserts 22. However, since air is fed into a groove portion **23*b* provided in the insert bodies 23 at one end portion thereof and into the sand release bores 18 and 9 and the air feed bores 9A and the fed air flows toward the outlet end of the sand outlet bores 9B, a negative pressure effect occurs which causes the shell sand to be sucked from the spiny insert receiving recesses 16 and discharged to the outlet through the sand release bores 18. Accordingly, the shell sand does not stagnate between the spiny insert receiving recesses 16 and the spiny inserts 22, whereby the spiny inserts 22** can move smoothly.

Further, since the groove portion **23*b* is provided between the spiny insert receiving recess 16 and the spiny insert 22 and the groove portion 23*b* extends from the curved top surface side of the shell molding insert 12 to the bottom portion of the spiny insert receiving recess 16, it is possible to prevent the shell sand from stagnating between the spiny insert receiving recess 16 and the spiny insert 22, whereby the spiny inserts 22** can move smoothly.

As has been described in detail above, in a shell molding process, a thermal expansion caused by heating and stagnant shell sand cause various kinds of errors, resulting in poorer precision of produced shell molds. The shell molding apparatus of the present invention has a structure to cancel such errors occurring in a shell molding process. Accordingly, it is possible to minimize variations in shape matching precision between the spiny insert and the shell molding insert. Also, the spiny inserts can move smoothly in an equalized manner, whereby halved shell molds of high precision are readily mass-produced.

What is claimed is:

1. A shell molding apparatus, comprising:

a lower die comprising:

a plurality of shell molding inserts disposed adjacent to one another, each of said shell molding inserts having the shape of a halved cylinder so as to include a curved surface, said shell molding inserts having a spiny insert receiving recess formed in said curved surface, and spiny inserts retractably provided in the spiny insert receiving recesses, each spiny insert having a curved surface of the same curvature as the curved surface of the shell molding insert and provided with many protrusions on the curved surface;

an upper die in which a body thereof has a plurality of continuously formed recesses corresponding to the plurality of shell molding inserts of said lower die;

spiny insert actuating means for projecting and retracting the spiny inserts by moving withdrawal pins connected to the spiny inserts;

stopper means for positioning said withdrawal pins at a position where said withdrawal pins exhibit an identical displacement due to thermal expansion; and thermal expansion absorbing means for absorbing thermal expansion of said withdrawal pins.

2. A shell molding apparatus according to claim 1, wherein said stopper means comprises a stepped stop end formed in a rod insertion bore portion provided in the shell molding insert and an end surface of each withdrawal pin which abuts against the stepped stop end, said rod insertion bore portion having a smaller-diameter portion which extends from the stepped stop end to the spiny insert receiving recess, and the length L1 of the smaller-diameter portion being identical for all the shell molding inserts.

3. A shell molding apparatus according to claim 2, wherein said thermal expansion absorbing means comprises a pin receiving member provided on a slide block, adjusting bolts screwed into said pin receiving member, and a spacing t formed between an end surface of each of said adjusting bolts and an end surface of each of said withdrawal pins held slidably by said slide block for absorbing variations in length of said withdrawal pins caused by thermal expansion.

4. A shell molding apparatus according to claim 1, wherein said spiny insert actuating means comprises a slide block for moving said withdrawal pins and an actuator cylinder for moving said slide block.

5. A shell molding apparatus according to claim 4, wherein said thermal expansion absorbing means comprises a pin receiving member provided on said slide block, adjusting bolts screwed into said pin receiving member, and a spacing t formed between an end surface of each of said adjusting bolts and an end surface of each of said withdrawal pins held slidably by said slide block for absorbing variations in length of said withdrawal pins caused by thermal expansion.

6. A shell molding apparatus according to claim 1, wherein said thermal expansion absorbing means comprises a pin receiving member provided on a slide block, adjusting bolts screwed into said pin receiving member, and a spacing t formed between an end surface of each of said adjusting bolts and an end surface of each of said withdrawal pins held slidably by said slide block for absorbing variations in length of said withdrawal pins caused by thermal expansion.

7. A shell molding apparatus, comprising:

a lower die comprising:

a plurality of shell molding inserts disposed adjacent to one another, each of said shell molding inserts having the shape of a halved cylinder so as to include a curved surface, said shell molding inserts having a spiny insert receiving recess formed in said curved surface, and spiny inserts retractably provided in the spiny insert receiving recesses, each spiny insert having a curved surface of the same curvature as the curved surface of the shell molding insert and provided with many protrusions on the curved surface;

an upper die in which a body thereof has a plurality of continuously formed recesses corresponding to the plurality of shell molding inserts of said lower die;

spiny insert actuating means comprising a slide block positioned and held by a slide block positioning/holding member and holding withdrawal pins inserted into pin insertion bores and an actuating mechanism for moving said slide block; and thermal expansion differential absorbing means.

8. A shell molding apparatus according to claim 7, wherein said thermal expansion differential absorbing means comprises lower die thermal expansion absorbing means for absorbing a thermal expansion of said lower die and slide block thermal expansion absorbing means for absorbing a thermal expansion of said slide block.

9. A shell molding apparatus according to claim 8, wherein said lower die thermal expansion absorbing means is a pin holding portion of said slide block which is provided on said slide block positioning/holding member, into which a slide pin is slidably inserted, and which has an oblong guide bore for enabling a relative movement of said slide pin.

10. A shell molding apparatus according to claim 9, wherein the pin holding portion of said slide block is a guide bushing.

11. A shell molding apparatus according to claim 8, wherein said slide block thermal expansion absorbing means is a pin insertion bore in said slide block which is formed oblongly in cross-section thereof for enabling said withdrawal pin to relatively move within said pin insertion bore.

12. A shell molding apparatus, comprising:

a lower die comprising:

a plurality of shell molding inserts disposed adjacent to one another, each of said shell molding inserts having the shape of a halved cylinder so as to include a curved surface, said shell molding inserts having a spiny insert receiving recess formed in said curved surface, and spiny inserts retractably provided in the spiny insert receiving recesses, each spiny insert having a curved surface of the same curvature as the curved surface of the shell molding insert and provided with many protrusions on the curved surface;

an upper die in which a body thereof has a plurality of continuously formed recesses corresponding to the plurality of shell molding inserts of said lower die;

spiny insert actuating means for projecting and retracting the spiny insert; and sand releasing means for removing sand which is caught between said spiny insert receiving recesses and said spiny inserts.

13. A shell molding apparatus according to claim 12, wherein said sand releasing means comprises a sand release bore extending between a bottom portion of the spiny insert receiving recess and a sand outlet, and an air feed bore connected to said sand release bore for feeding air into said sand release bore.

14. A shell molding apparatus according to claim 12, wherein said sand releasing means comprises a sand release bore extending between a bottom portion of said spiny insert receiving recess and a sand outlet, an air feed bore connected to said sand release bore for feeding air into said sand release bore, and a groove portion provided between said spiny insert receiving recess and said spiny insert inserted into the spiny insert receiving recess and extending from a top surface side of said shell molding insert to the bottom portion of said spiny insert receiving recess.

* * * * *